US006165026A

United States Patent [19]

Sugie et al.

[11] Patent Number: 6,165,026

[45] **Date of Patent: *Dec. 26, 2000**

[54] TERMINAL

[75] Inventors: Naoto Sugie; Shinichi Tsuchiya, both of Shizuoka, Japan

[73] Assignee: Yazaki Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/045,900

[22] Filed: Mar. 23, 1998

[30] Foreign Application Priority Data

Mar. 25, 1997 [JP] Japan ..... 9-071799
Jan. 13, 1998 [JP] Japan ..... 10-004941

[51] Int. Cl.[7] ..... H01R 13/434

[52] U.S. Cl. ..... 439/748; 439/746

[58] Field of Search ..... 439/744, 745, 439/746, 747, 748, 749, 750, 733.1, 345, 350, 353, 354

[56] References Cited

U.S. PATENT DOCUMENTS 4,046,450 9/1977 Yurtin ..... 339/217 S
5,716,242 2/1998 Myer ..... 439/748
5,951,336 9/1999 Seko et al. ..... 439/745

FOREIGN PATENT DOCUMENTS 86 08 199 6/1986 Germany .
62-173179 11/1987 Japan .
3-147282 6/1991 Japan .
3-126370 12/1991 Japan .
5-48233 6/1993 Japan .
10162891 6/1998 Japan .

*Primary Examiner*—Lincoln Donovan
*Attorney, Agent, or Firm*—Armstrong, Westerman, Hattori, McLeland & Naughton

[57] ABSTRACT

A terminal with a locking member capable of surely preventing damage of the locking member even in case the terminal inserted and locked in a connector housing is pulled reversely. An electric contact portion of the terminal has a cantilever-like locking member and protection walls for the locking member thereby to engage the locking member with a locking step of the connector housing, and further engaging-arm portions are provided on the locking member and arm-engaged portions engaging with the engaging-arm portions are also provided on the protection walls. Projections may be provided on free end portions of the engaging-arm portions. Further, as another type of locking member, extending walls each having an abutting edge, which abuts against the locking step when the terminal is pulled reversely, may be provided on a locking member. Different type of engaging-arm portions and engaging openings relative to the engaging-arm portions may be formed on the extending walls and on the protection walls, respectively. A reinforcing piece may be provided over the locking member to reinforce it. Thus, a terminal with a locking member capable of surely preventing damage of the locking member on being pulled reversely can be realized.

2 Claims, 13 Drawing Sheets

TERMINAL

BACKGROUND OF THE INVENTION

1. Field of the Invention

The present invention relates to a terminal inserted and locked in a terminal accommodating chamber of a connector housing.

2. Description of the Prior Art

FIGS. 11,12 and 13 show a prior art terminal.

This terminal 51 has an electric contact portion 53 for receiving a mating terminal (not shown) at one end of a rectangular base plate 52 and a wire-connecting portion 54 for fixing an electric wire (not shown) at the other end.

The electric contact portion 53 has standing side walls 55*a*,55*b* on both sides of the base plate 52, and a locking member 56 and protection walls 57 are formed on the side walls 55*a*,55*b*. The wire-connecting portion 54 consists of a conductor fixer 58 for fixing a conductor of a wire and a sheathing fixer 59 for fixing a sheathed portion of the wire, both standing on the base plate 52. Reference numeral 60 is a connection belt connecting a plurality of terminals 51.

As shown in FIG. 13, when the wire is pulled after insertion of a wired terminal 51' into a terminal accommodating chamber 62 of a connector housing 61, the terminal 51 moves in the corresponding direction. Coming-out of the wired terminal 51' is prevented with abutment of an edge 56*a* of the locking member 56 against a locking step 63.

In the above prior art terminal, however, when the wired terminal 51' is pulled excessively, a middle portion 56*b* of the locking member 56 deforms in a bow shape as shown in FIG. 14, and then the locking member 56 has been apt to be damaged. And, incomplete accommodation of the terminal 51 or coming-out of the terminal 51 from the terminal accommodating chamber 62 occurred. In such case, a mating connector (not shown) could not be connected to the terminal 51.

As another prior art, a terminal 70 shown in FIGS. 15 and 16 has been disclosed in Japanese Utility Model Registration Application Laid-open No. 62-173179.

Referring to FIGS. 15 and 16, the terminal 70 has a rectangle-tubular electric contact portion 72 at one end of a base plate 71 and a wire-connecting portion 73 at the other end. A resilient locking member 74 stands from an end of the base plate 71 in the electric contact portion 72, and projecting pieces 75 are provided on both sides of the locking member 74 and engaging openings 76 are provided on respective side walls 72*a* of the electric contact portion 72, whereby movement of free end portions of the projecting pieces 75 is restricted within the engaging openings 76.

On inserting the terminal 70 into a terminal accommodating chamber 82 of a connector housing 81, the locking member 74 of the terminal 70 and a locking step 83 projecting in the terminal accommodating chamber 82 abut each other. In case the terminal 70 is pulled reversely in the above state, a free end 74*a* of the locking member 74 abuts against a front end surface 83*a* of the locking step 83, thereby preventing coming-out of the terminal 70.

However, since thickness d' of the locking member 74 is thin, the locking member 74 has been apt to be damaged or deformed in case the terminal 70 is pulled in a direction R, thereby resulting in imperfect retaining of the terminal 70 in the terminal accommodating chamber 82. And, for example, even in case of drawing out the terminal 70 engaged in the terminal accommodating chamber 82 using a drawing jig (not shown), the locking member 74 was deformed easily.

Further, since the engaging openings 76 have to be located at high position in the side walls 72*a* in compliance with position of the projecting pieces 75 of the locking member 74, high side walls have been required, resulting in the terminal 70 with a large height.

SUMMARY OF THE INVENTION

An object of the present invention is to provide a terminal capable of surely preventing damage of a locking member even in case the terminal inserted and locked in a terminal accommodating chamber is pulled reversely.

In order to achieve the above object, as a first feature of the present invention, the present invention adopts a terminal having a rectangle-tubular contact-portion body, as an electric contact portion, having a cantilever-like locking member formed integrally with the contact-portion body and having protection walls arranged on both sides of the locking member, thereby enabling the locking member to engage with a locking step formed in a terminal accommodating chamber of a connector housing, wherein engaging-arm portions are provided on free end side of the locking member and arm-engaged portion, engaging with the engaging-arm portion, is provided on each of the protection walls by notching them. The terminal may be provided with a projection on a free end portion of each engaging-arm portion.

And, as a second feature of the present invention, the present invention adopts a terminal having a rectangle-tubular contact-portion body, as an electric contact portion, having a cantilever-like locking member formed integrally with the contact-portion body and having protection walls arranged on both sides of the locking member, thereby enabling the locking member to engage with a locking step formed in a terminal accommodating chamber of a connector housing, wherein extending walls each are provided on both sides of free end portion of the locking member and an abutting edge of each extending wall abuts against the locking step when the terminal inserted into the terminal accommodating chamber is pulled reversely. And, the terminal may have engaging-arm portions formed by outwardly bending each free end portion of the extending walls and have engaging openings each formed on the respective protection walls, wherein each of the engaging-arm portions engages with respective inner edges of the engaging openings when the terminal inserted into the terminal accommodating chamber is pulled reversely so that buckling of the locking member is prevented. Further, the terminal may have a reinforcing piece on the contact-portion body so as to reinforce a root portion of the locking member According to the present invention as described hereinabove, since the engaging-arm portions are provide on the locking member formed on the contact-portion body and the arm-engaged portions engaging with the engaging-arm portions are formed on the protection walls, the engaging-arm portions engage with the arm-engaged portions when the terminal inserted into the terminal accommodating chamber is pulled reversely, thereby preventing deformation of the terminal. Consequently, the terminal does not shake in the terminal accommodating chamber, thereby enabling the terminal to be connected easily to a mating one and also ensuring stable electric connection between them. Further, damage or coming-out of the terminal from the terminal accommodating chamber is surely prevented.

And, since the projections are provided on the free end portions of the engaging-arm portions, sure engagement between the engaging-arm portions and the arm-engaged portions is obtained, thereby further ensuring to prevent damage of the locking member.

Also, since the extending walls are provided on the locking member, the abutting edges on the extending walls abut against the locking step in the terminal accommodating chamber, thereby improving retaining force of the terminal within the terminal accommodating chamber.

Further, since the engaging-arm portions are provided on the extending walls, the engaging-arm portions can be located at a lower position of the contact-portion body, thereby enabling to reduce height of the protection walls, i.e. height of the terminal. And, since the engaging-arm portions engage the engaging openings when the terminal is pulled reversely, buckling of the locking member can be prevented.

Still further, since the reinforcing piece on the contact-portion body reinforces the root portion of the locking member, the locking member itself is strengthened, thereby deformation or damage of the locking member can be prevented even in case the terminal is pulled reversely. Also, when the terminal is drawn out by means of a drawing jig, buckling of the locking member can be prevented.

Moreover, since the reinforcing piece besides the extending walls further strengthens the locking member, deformation or damage of the locking member is surely prevented even in case the terminal is pulled reversely.

The above and other objects and features of the present invention will be more apparent from the following description taken in conjunction with the accompanying drawings.

DETAILED DESCRIPTION OF THE PREFERRED EMBODIMENTS

Embodiments of the present invention will now be described in further detail with reference to the accompanying drawings.

FIG. 1 through FIG. 5 show a first embodiment of a terminal according to the present invention. In this embodiment, a contact-portion body forming an electric contact portion at the intermediate portion has a locking member and protection walls. The contact-portion body, however, may have a locking member on one side and protection walls may be arranged vertically on both sides of the locking member by directly bending a base plate. The same description is given to the same structural member as in the prior art, and its detailed explanation is omitted hereinafter.

Figure 1:
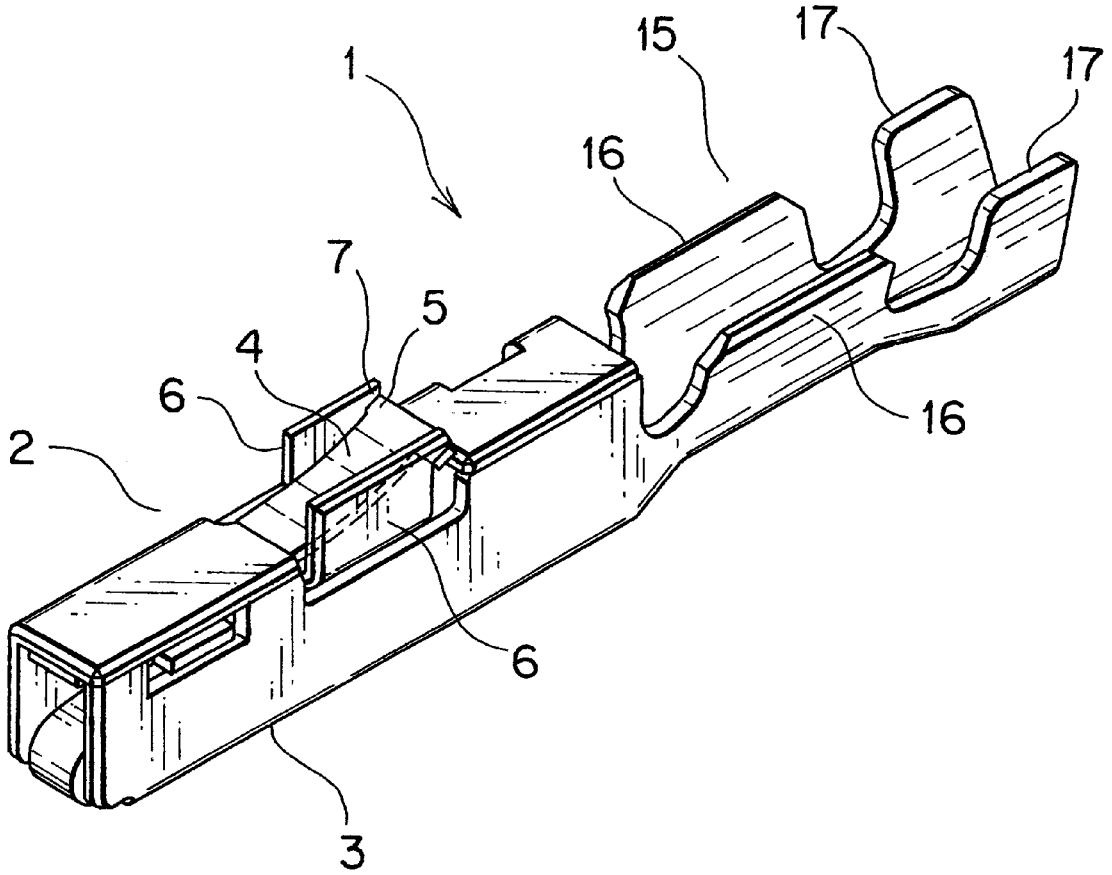
FIG. 1 is a perspective view showing a first embodiment of a terminal in accordance with the present invention.

As shown in FIG. 1, the terminal 1 integrally consists of an electric contact portion 2 and a wire-connecting portion 15 on the front and rear sides, respectively, of a base plate (not shown), and engaging-arm portions 5 are provided on a resilient locking member 4 made up integrally with a contact-portion body 3 forming the electric contact portion 2, and arm-engaged portion 7 engaging with the engaging-arm portion 5 is formed on each of protection walls 6. The protection walls 6 protect the locking member 4.

Figure 2:
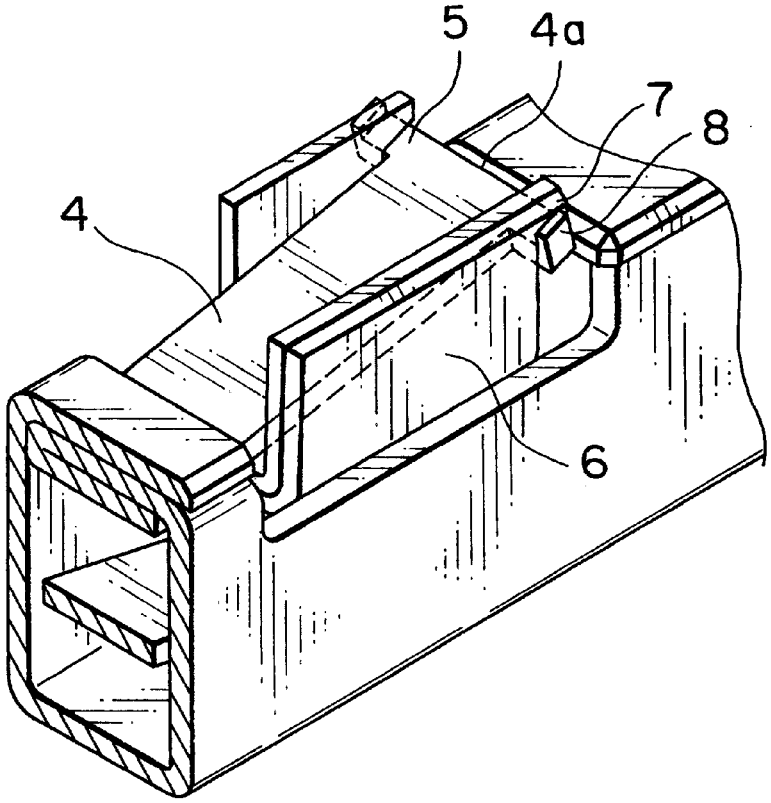
FIG. 2 is an enlarged perspective view of a main portion of FIG. 1.
Figure 3:
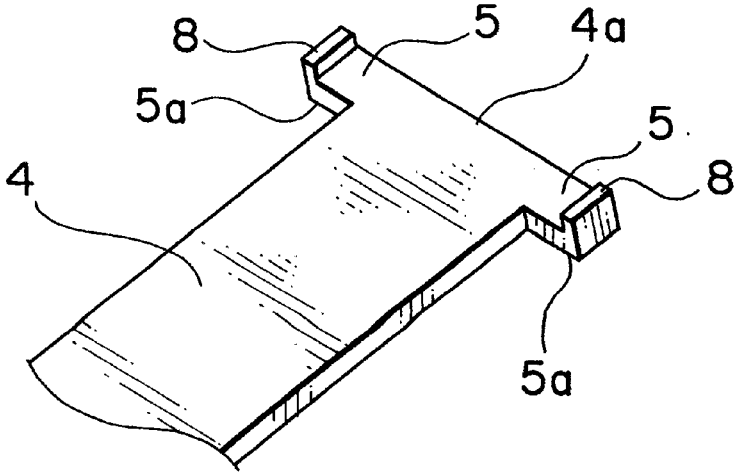
FIG. 3 is an enlarged perspective view of a locking member of FIG. 1.

As shown in FIGS. 2 and 3, the engaging-arm portions 5 extend transversely on both sides of the locking member 4 at its free end 4*a*. The arm-engaged portion 7 is formed in step-like on the protection wall 6 by linearly notching the wall 6 from bottom to near top. The arm-engaged portion 7 may allow another shape. An inclined surface on the arm-engaged portion 7 ensures an engagement with the engaging-arm portion 5. And, an upward projection 8 on a free end portion 5*a* of the engaging-arm portion 5 ensures an engagement between the engaging-arm portion 5 and the arm-engaged portion 7. Reference numeral 16 (FIG. 4) shows a conductor fixer fixing a conductor 12*a* of a wire 12 and reference numeral 17 shows a sheathing fixer fixing a sheathed portion 12*b* of the wire 12.

Figure 4:
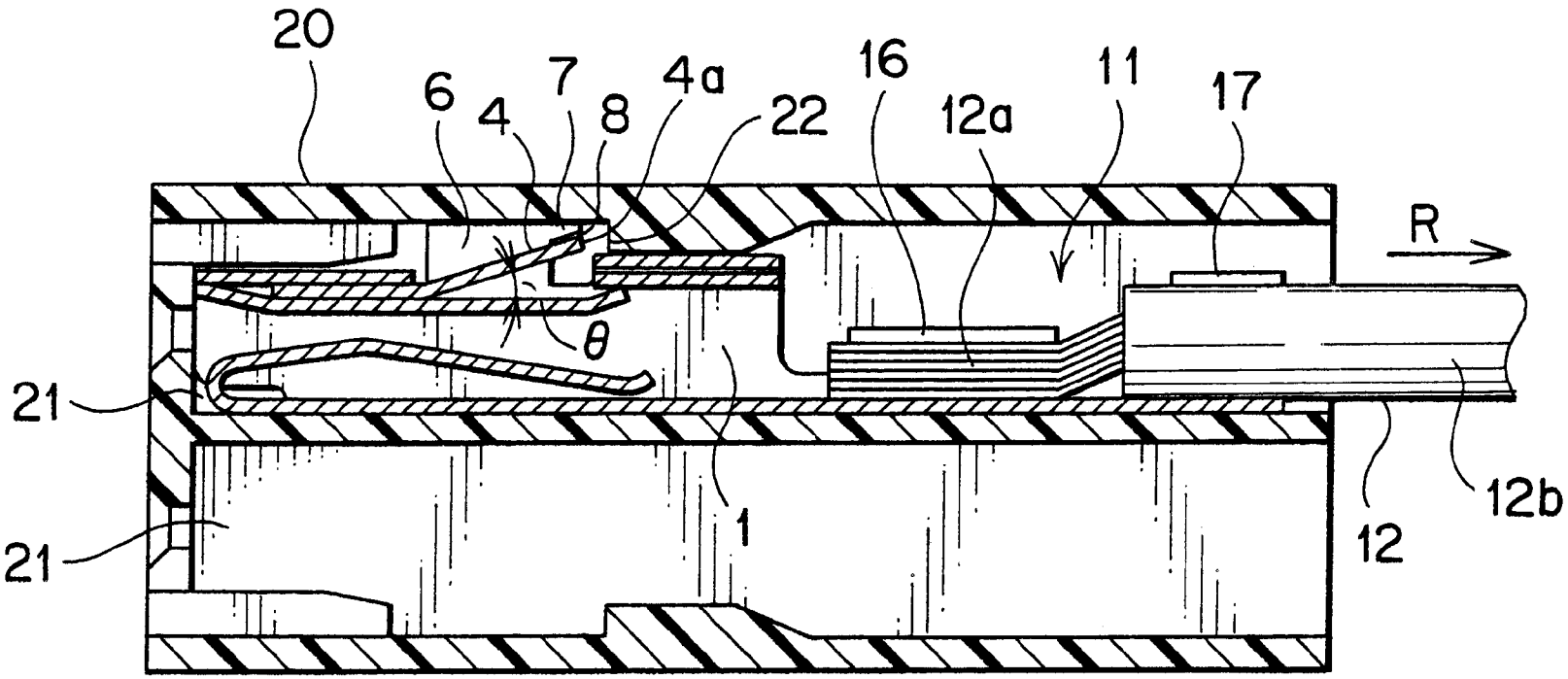
FIG. 4 is a longitudinal-sectional view showing a state of a wired terminal inserted into a terminal accommodating chamber of a connector housing.

Next, as shown in FIG. 4, an action of the engaging-arm portion 5, in a state that a wired terminal 11 accommodated in a terminal accommodating chamber 21 of a connector housing 20 is pulled in an opposite direction (direction R) to an insertion direction of the terminal 1, is described.

The wired terminal 11 in the terminal accommodating chamber 21 moves in the direction R when the wire 12 is pulled in the direction R. Upon movement of the wired terminal 11, the free end 4*a* of the locking member 4 abuts a locking step 22 provided in the terminal accommodating chamber 21.

Figure 5:
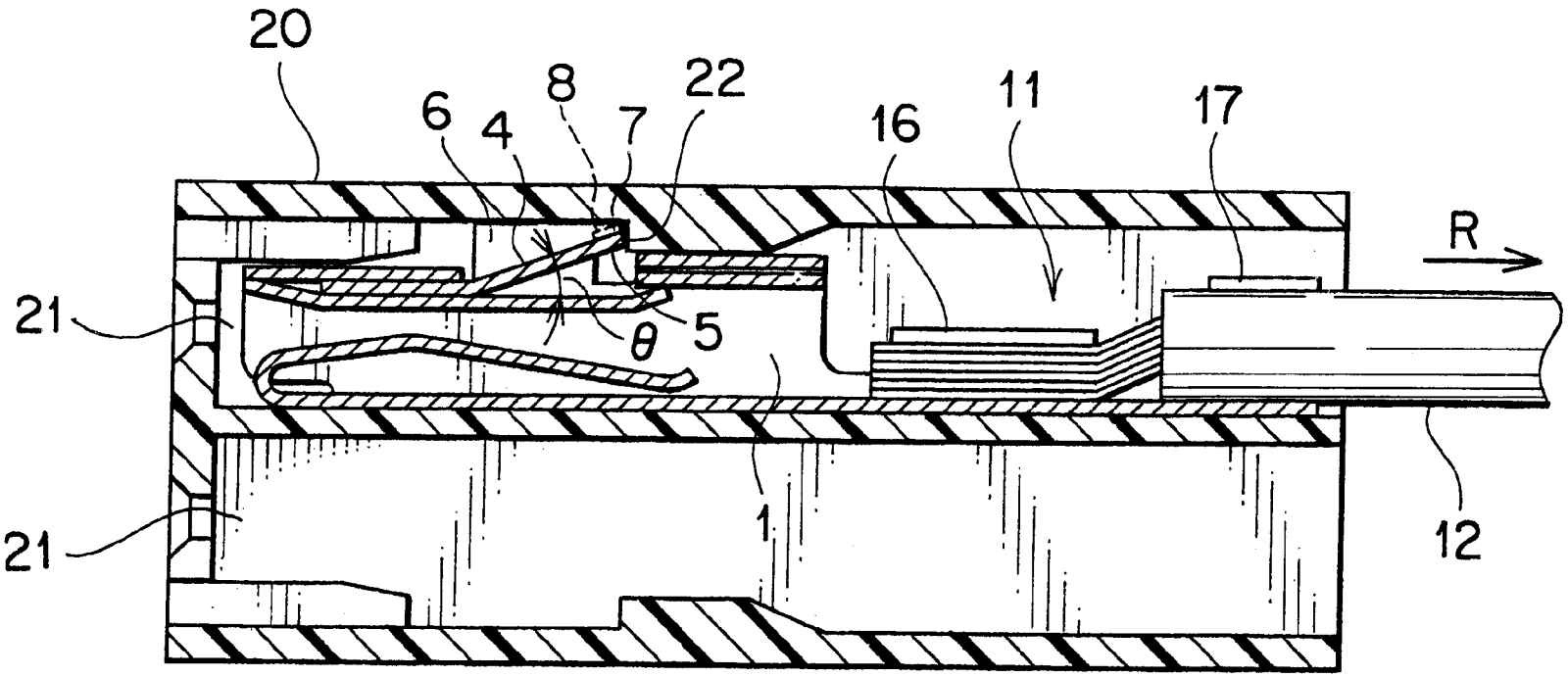
FIG. 5 is also a longitudinal-sectional view showing a state of an electric wire of FIG. 4 pulled in a direction R.

If the terminal 1 is still pulled, tilt angle θ of the locking member 4 increases in a state that the free end 4*a* of the locking member 4 abuts against the locking step 22. As shown in FIG. 5, as increasing the tilt angle θ of the locking member 4, the engaging-arm portions 5 of the locking member 4 strike the arm-engaged portions 7 of the protection walls 6 and abut against them. That is, further increase in the tilt angle θ of the locking member 4 due to withdrawal of the terminal 1 is prevented by the engagement between the engaging-arm portions 5 and the arm-engaged portions 7, thereby preventing deformation or damage of the locking member 4.

FIG. 6 through FIG. 10 show a second embodiment of a terminal in accordance with the present invention. In this embodiment, the same description is given to the same structural member as in the first embodiment, and their detailed explanation is omitted.

Figure 6:
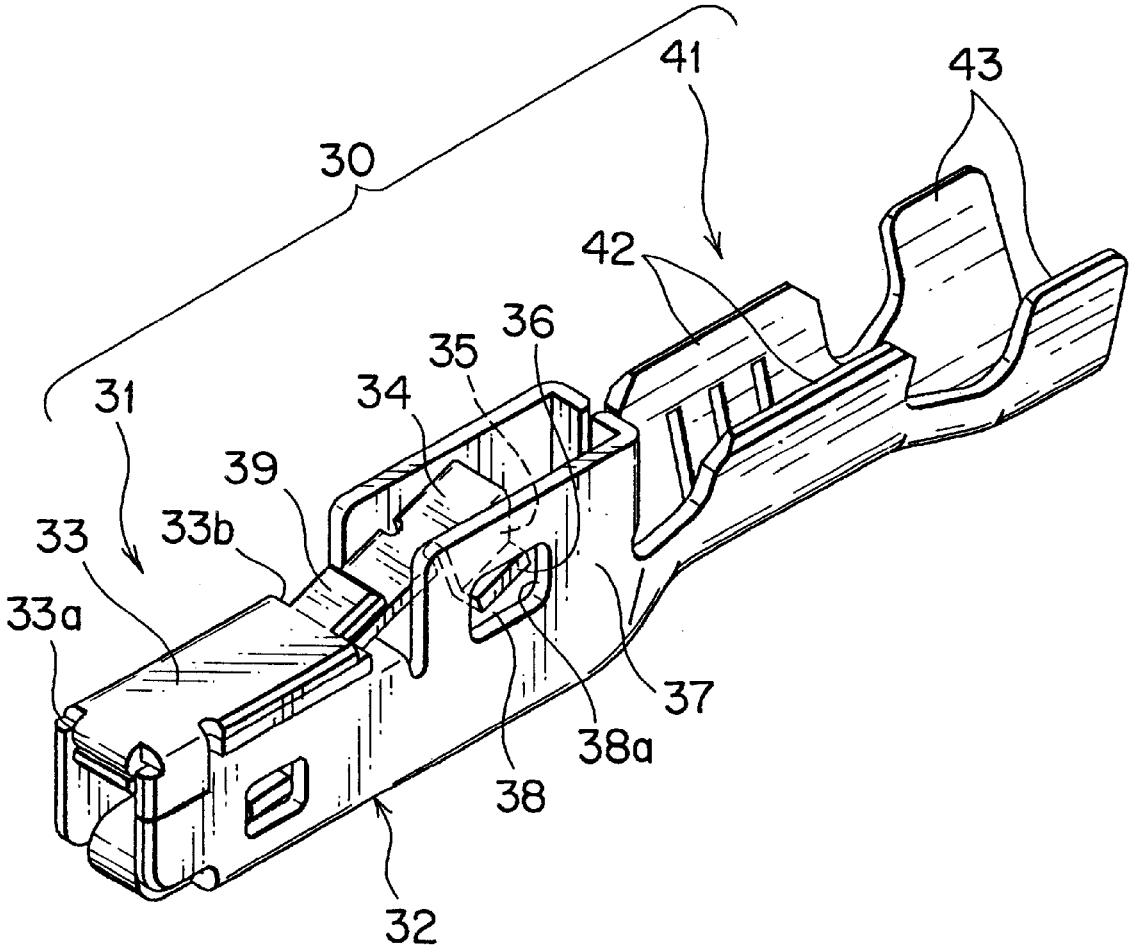
FIG. 6 is a perspective view showing a second embodiment of a terminal in accordance with the present invention.

Referring to FIG. 6, this terminal 30 has a resilient locking member 34 folded at one end 33*a* of a ceiling wall 33 of a rectangle-tubular contact-portion body 32 forming an electric contact portion 31, and extending walls 35 each having an engaging-arm portion 36 at its free end portion 34*a* by outwardly bending itself are provided downwardly on both sides of the locking member 34, and further engaging openings 38 each are formed on respective protection walls 37,37 located on both sides of the locking member 34.

Figure 7:
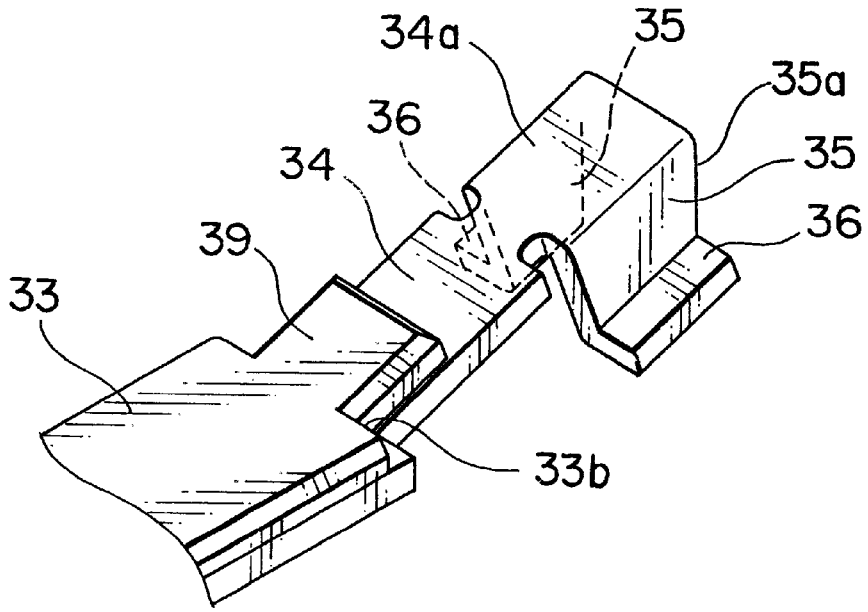
FIG. 7 is an enlarged perspective view of a locking member of FIG. 6.
Figure 8:
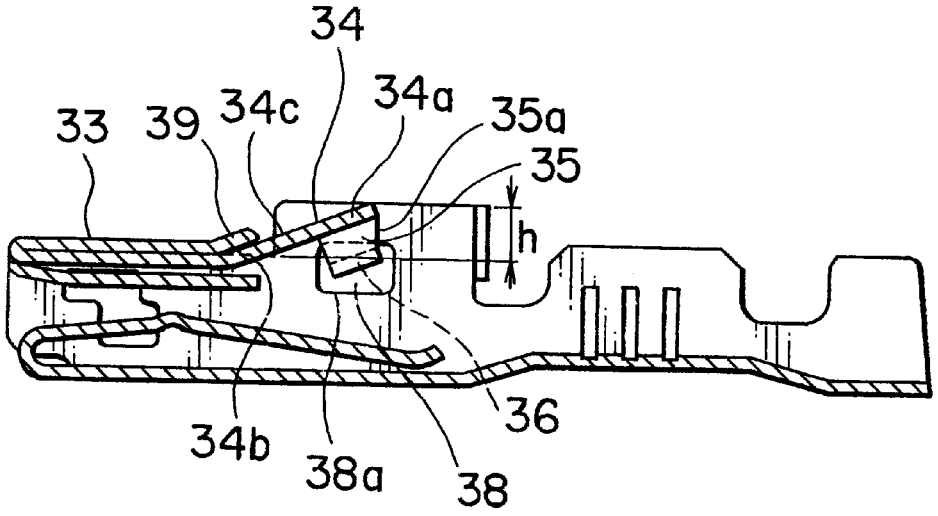
FIG. 8 is a longitudinal-sectional view of FIG. 6.

As shown in FIGS. 7 and 8, each of the extending walls 35 on the locking member 34 has an abutting edge 35*a* on the side of a free end of the locking member 34. It is preferable that height d (FIG. 9) of the extending wall 35 is larger than height D of a locking step 22 projecting from a terminal accommodating chamber 21,i.e. d>D.

In case the engaging-arm portions 36 on the extending walls 35 are located in the engaging openings 38, the engaging-arm portions 36 engage with inner edges 38*a* of the engaging openings 38. In this embodiment, since the engaging-arm portions 36 are provided on the extending walls 35, the engaging-arm portions 36 can be located below the locking member 34 according to the height d of the extending walls 35.

Referring to FIGS. 6 and 7, a reinforcing piece 39 laid on the locking member 34 projects from the other end 33*b* of the ceiling wall 33 so as to protect a root portion 34*b* of the locking member 34. The reinforcing piece 39 besides the extending walls 35 makes the locking member 34 stronger than a conventional locking member.

Figure 10:
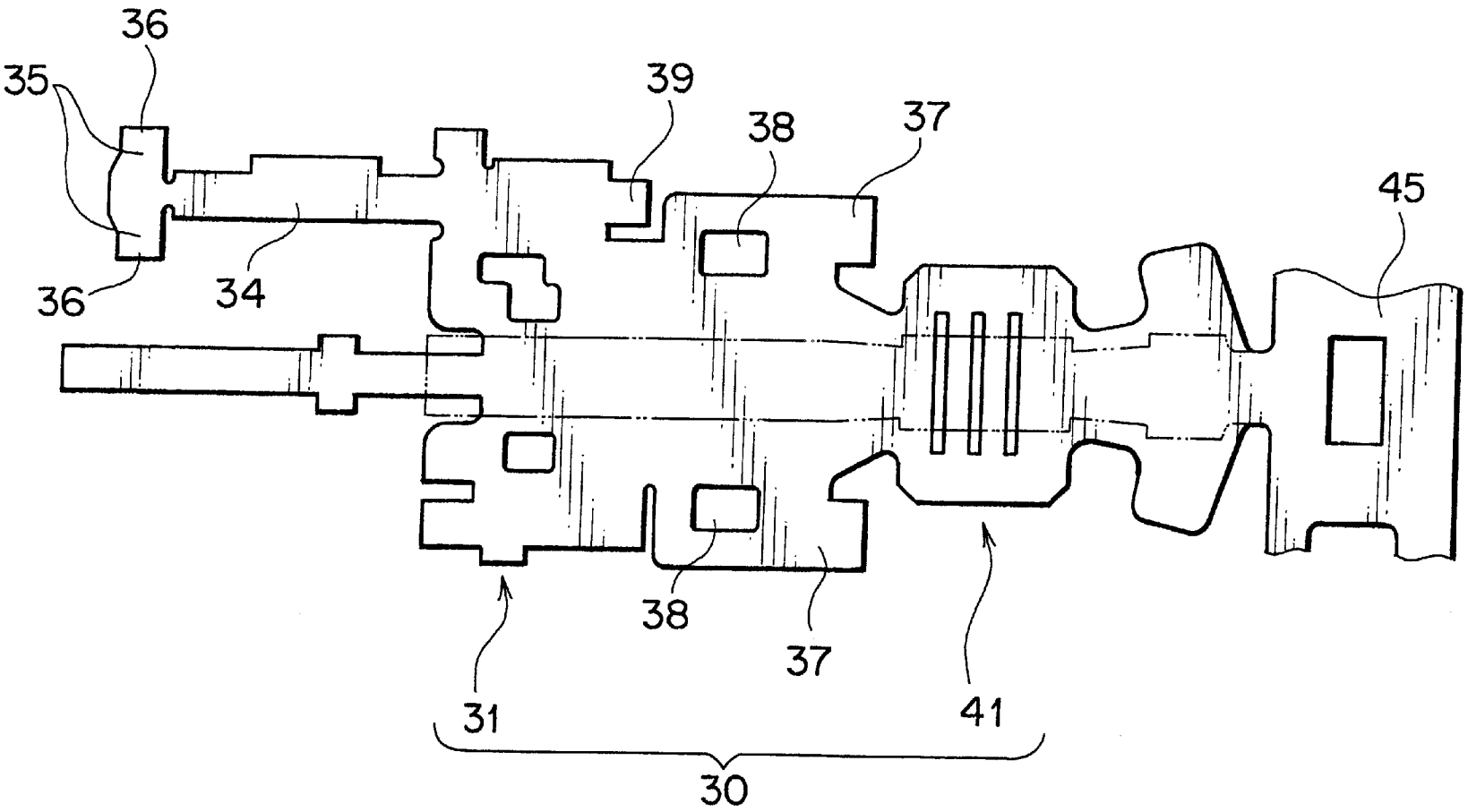
FIG. 10 is an exploded view of the terminal of FIG. 6.
Figure 11:
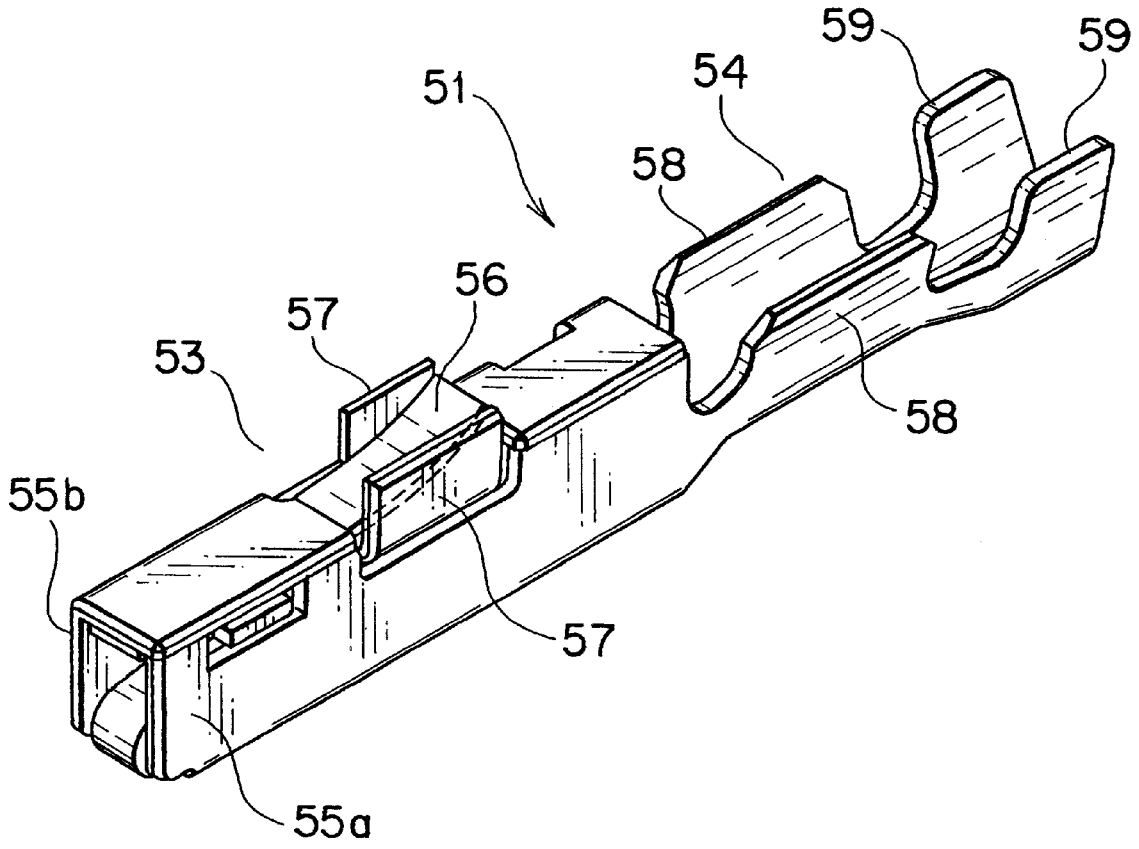
FIG. 11 PRIOR ART
FIG. 11 is a perspective view showing a prior art terminal.
Figure 12:
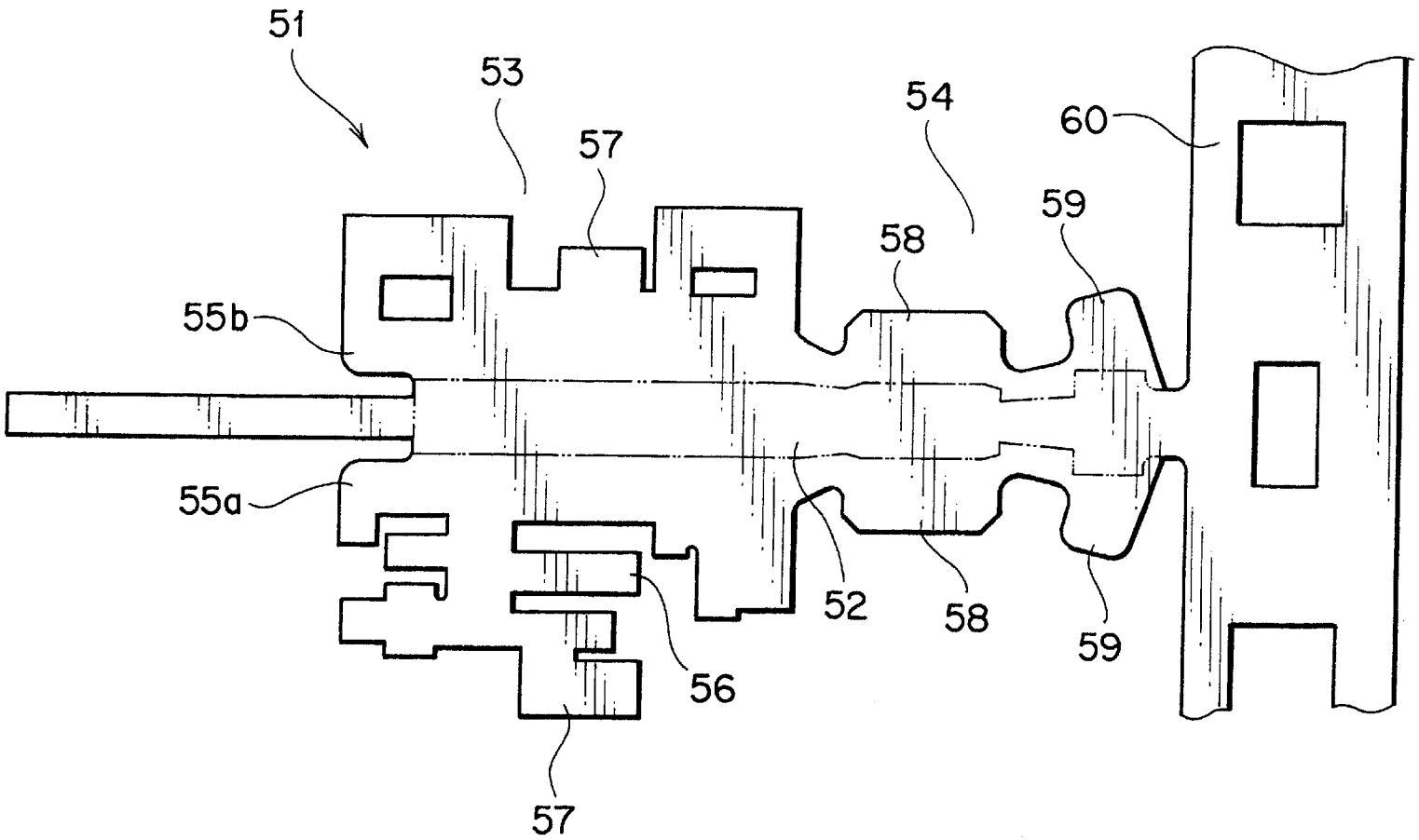
FIG. 12 PRIOR ART
FIG. 12 is an exploded view of the terminal of FIG. 11.
Figure 13:
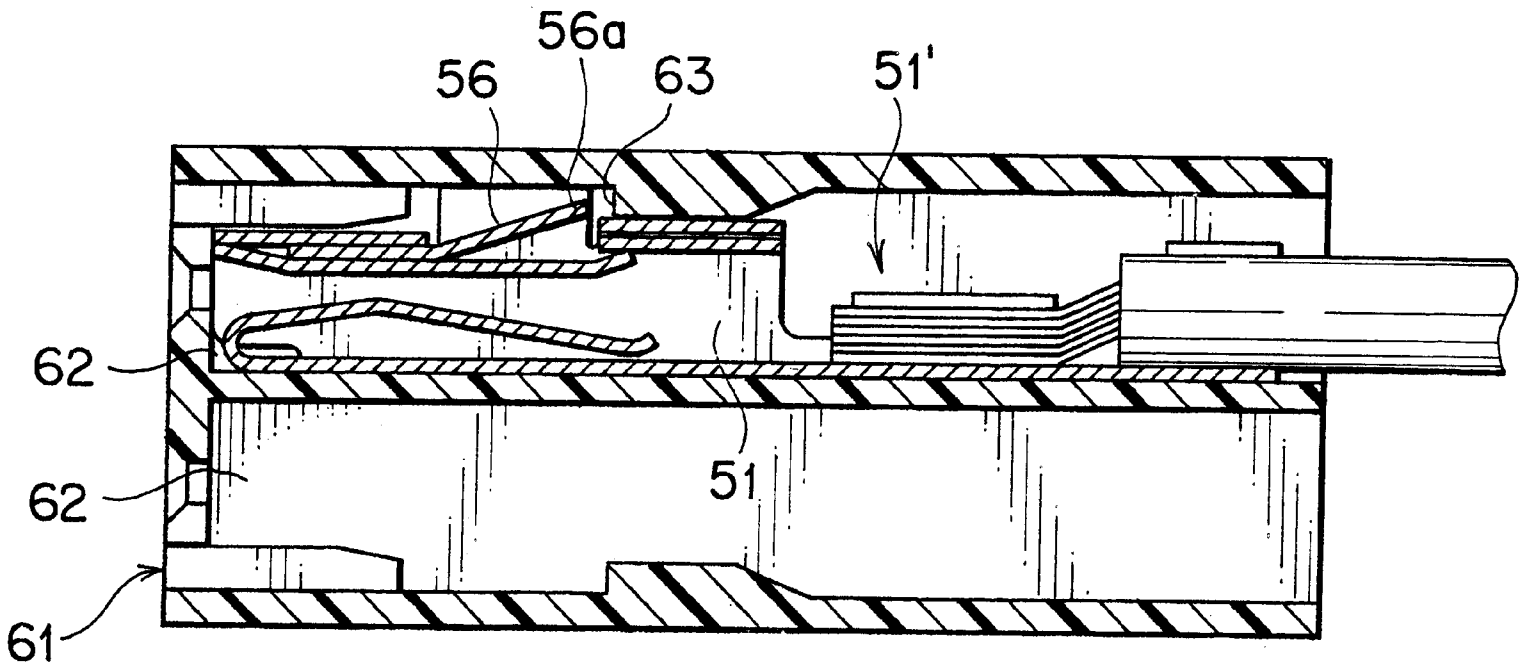
FIG. 13 PRIOR ART
FIG. 13 is a longitudinal-sectional view showing a state of a terminal of FIG. 11 wired and inserted into a terminal accommodating chamber of a connector housing.
Figure 14:
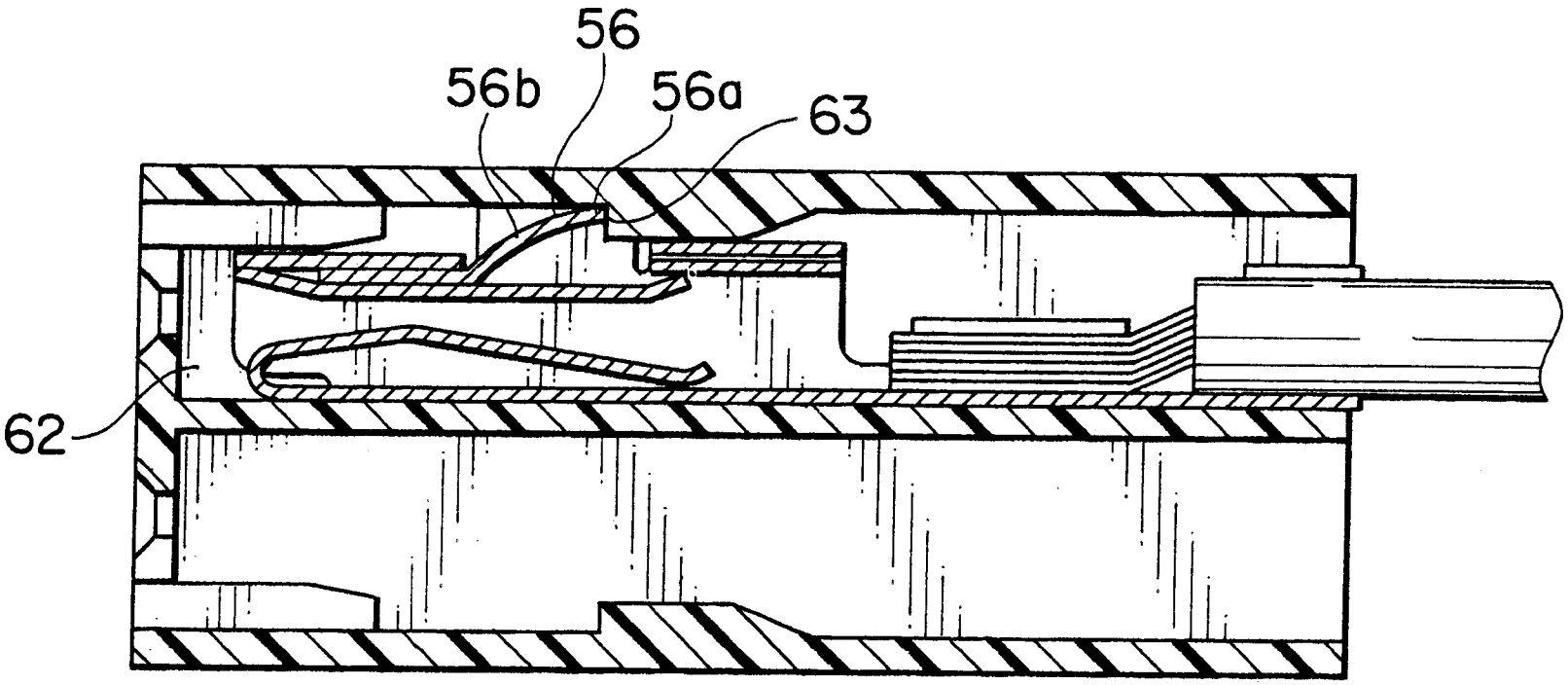
FIG. 14 PRIOR ART
FIG. 14 is also a longitudinal-sectional view showing a locking member of FIG. 13 in a state of deformation with an electric wire being pulled.
Figure 15:
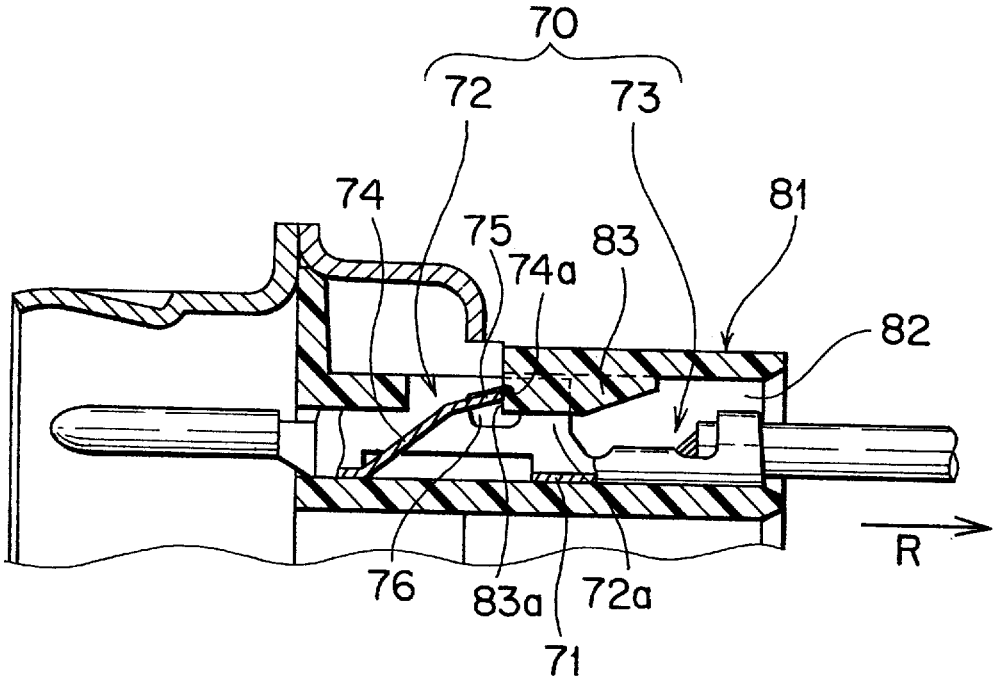
FIG. 15 PRIOR ART
FIG. 15 is a longitudinal-sectional view showing a state of another prior art terminal inserted into a connector housing.
Figure 16:
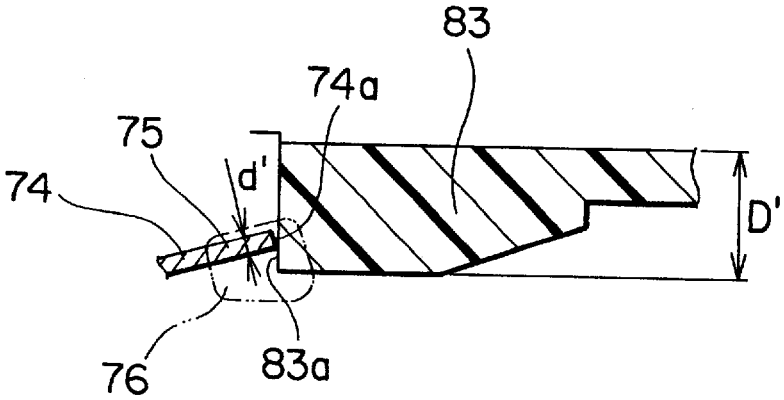
FIG. 16 PRIOR ART
FIG. 16 is a partially enlarged sectional view showing a state of engagement between a locking member and a locking step of FIG. 15.

FIG. 10 shows an exploded view. The electric contact portion 31 or a wire-connecting portion 41 are formed by bending a metal plate having been punched, and cutting a connection belt 45 completes manufacture of the terminal. Reference numerals 42 and 43 are a pair of conductor fixers and of sheathing fixers, respectively.

Figure 9:
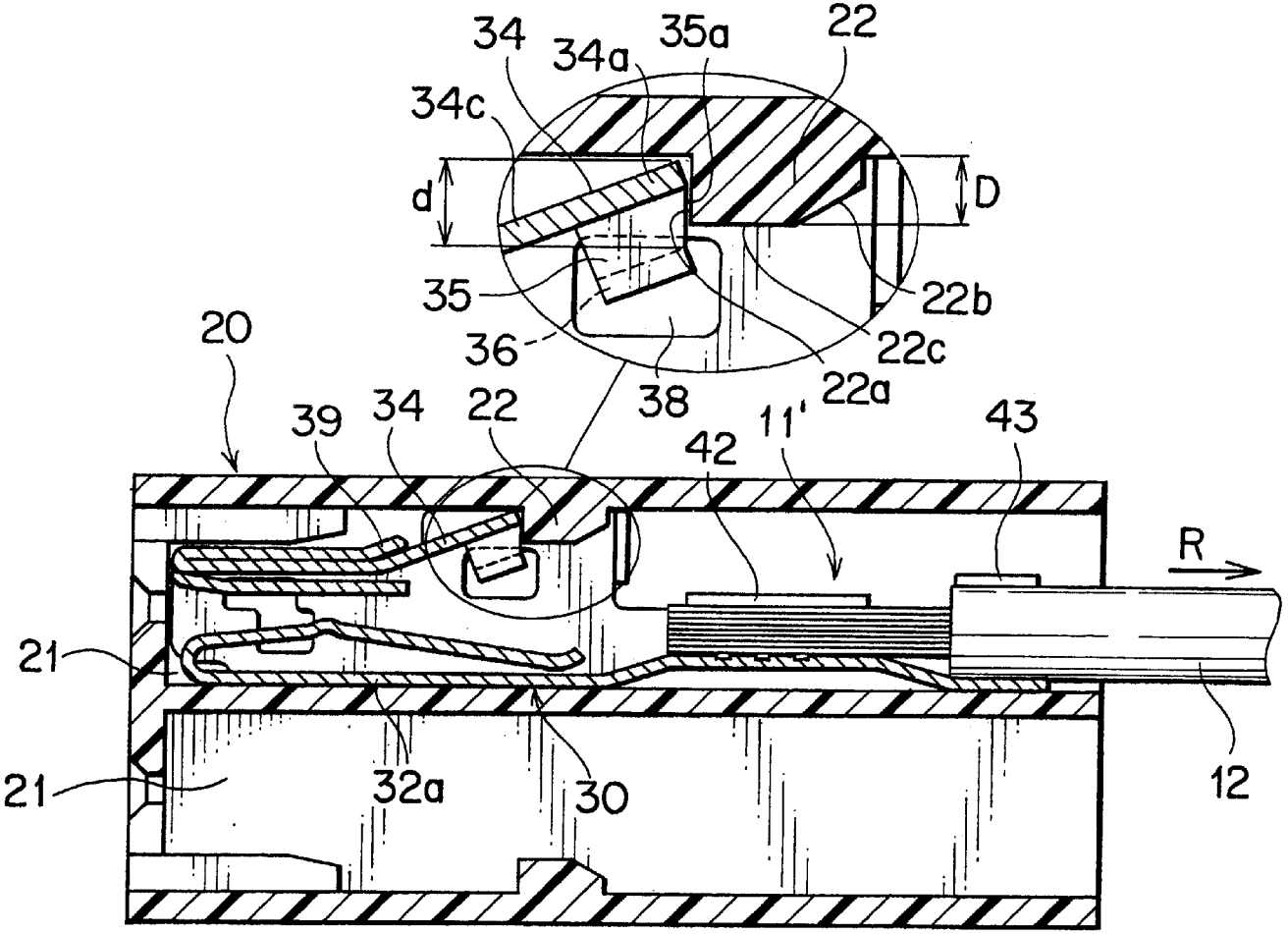
FIG. 9 is a longitudinal-sectional view showing a state of a wired terminal inserted into a terminal accommodating chamber of a connector housing and pulled in a direction R.

Next, as shown in FIG. 9, an action of the engaging-arm portion 36, in a state that a wired terminal 11' accommodated in a terminal accommodating chamber 21 of a connector housing 20 is pulled reversely (in a direction R),is described.

As inserting the terminal 30 into the terminal accommodating chamber 21, an upper surface 34*c* of the locking member 34 of the terminal 30 is put in contact with a rear inclined surface 22*b* on the locking step 22 in the terminal accommodating chamber 21. The locking member 34 bends by pressure by the locking step 22 and the free end portion 34*a* of the locking member 34 slides in contact with a lower surface 22*c* of the locking step 22. The locking member 34 recovers in a original state after passing a front end surface 22*a* of the locking step 22, during which the engaging-arm portions 36 are in the respective engaging openings 38.

In case the terminal 30 is pulled reversely in the above state, the abutting edges 35*a* of the extending walls 35 abut the front end surface 22*a* of the locking step 22 and also the engaging-arm portions 36 engage with the inner edges 38*a* of the engaging openings 38, thereby preventing coming-out of the terminal 30. And, in this state, an abutting area between the locking member 34 and the front end surface 22*a* of the locking step 22 is larger than a conventional one.

What is claimed is:

1. A terminal for use with a connector assembly having a locking step projecting inwardly in a terminal accommodating chamber for preventing disengagement of said terminal, said terminal comprising:

a contact-portion body with a hollow rectangular cross-section forming an electric contact portion;

a cantilevered locking member formed integrally with said contact-portion body for engaging with said locking step of said connector housing and having a free end provided with an engaging arm extending transversely outwardly, said engaging arm having an end projection extending upwardly from a distal end thereof; and protection walls provided on said contact-portion body so as to be arranged on both sides of said locking member for protecting said locking member, said protection walls having an engaging portion extending rearwardly to be engageable with said engaging arm, wherein said end projection ensures to engage said engaging arm with said engaging portion.

2. A terminal for use with a connector assembly having a locking step projecting inwardly in a terminal accommodating chamber for preventing disengagement of said terminal, said terminal comprising:

a contact-portion body with a hollow rectangular cross section forming an electric contact portion;

a cantilevered locking member formed straight and integrally with said contact-portion body for engaging with said locking step of said connector housing;

protection walls provided on said contact-portion body so as to be arranged on both sides of said locking member for protecting said locking member;

extending walls extending in a vertical direction from said locking member on both sides of a free end portion thereof;

abutting edges each formed on said extending walls for abutting against said locking step when said terminal inserted into said terminal accommodating chamber is pulled in a reverse direction so that an abutting area increases, thereby securely locking said terminal in said terminal accommodating chamber;

engaging arms each extending outwardly from each free end portion of said extending walls;

engaging openings each formed on said protection walls for engaging inner edges of said engaging openings with said engaging arm when said terminal inserted into said terminal accommodating chamber is pulled in a reverse direction, wherein said engaging openings are spaced apart and each of said engaging openings is at a distance from each upper end of said protection walls thereby to reduce height of said protection walls; and a reinforcing piece provided on said contact-portion body for reinforcing a root portion of said cantilevered locking member, the whole of one side surface of said reinforcing piece being in contact with said cantilevered locking member.

* * * * *